US005879136A

United States Patent [19]

Robeller et al.

[11] Patent Number: 5,879,136

[45] Date of Patent: Mar. 9, 1999

[54] ELECTROHYDRAULIC ADJUSTABLE PUMP

[75] Inventors: Walter Robeller, Böblingen; Berthold Pfuhl, Markgröningen; Volkmar Leutner, Friolzheim; Dieter Bertsch, Neuhausen; Joachim Zumbraegel, Eberdingen, all of Germany

[73] Assignee: Robert Bosch GmbH, Stuttgart, Germany

[21] Appl. No.: 687,511

[22] PCT Filed: Mar. 23, 1995

[86] PCT No.: PCT/DE95/00402

§ 371 Date: Aug. 1, 1996

§ 102(e) Date: Aug. 1, 1996

[87] PCT Pub. No.: WO95/26470

PCT Pub. Date: Oct. 5, 1995

[30] Foreign Application Priority Data

Mar. 28, 1994 [DE] Germany ..... 44 10 719.6

[51] Int. Cl.[6] ..... F04B 49/00

[52] U.S. Cl. ..... 417/214; 417/222.1

[58] Field of Search ..... 417/222.1, 218, 417/214, 42, 18, 21, 27, 213; 60/390, 449, 911

[56] References Cited

U.S. PATENT DOCUMENTS

| | | | |
|---|---|---|---|
| 3,788,775 | 1/1974 | Leutner et al. | 417/222.1 |
| 4,285,639 | 8/1981 | Woodring et al. | 417/218 |
| 5,064,351 | 11/1991 | Hamey et al. | 417/222.1 |

*Primary Examiner*—Ismael Izaguirre
*Attorney, Agent, or Firm*—Michael J. Striker

[57] ABSTRACT

An electro hydraulically adjustable pump has an adjustment member which is adjustable by at least one adjustment piston, a control valve which acts upon the at least one adjusting piston, a servo amplifier which triggers the control valve and which is supplied with an actual value of a pump adjustment and an actual value of a control valve adjustment, and an element which produces an additional pulse-shape adjusting signal as a function of an angle of rotation of the pump so as to control the control valve through the servo amplifier by the additional pulse-shaped adjustment signal.

10 Claims, 2 Drawing Sheets

ELECTROHYDRAULIC ADJUSTABLE PUMP

BACKGROUND OF THE INVENTION

The invention relates to a pump the, which can be electrohydraulically adjusted. Such pumps, in particular axial, radial piston or vane cell pumps, are known in many embodiments and are employed in many different areas of use in hydraulic engineering. In connection with this, the main advantages of the electrohydraulic adjustment of these pumps are the rapid and precise electrical controllability and the low losses of the drive constructed by means of them because of the absence of expensive valves between the pump and the consumer. In this case the control pistons of the pumps are charged with a pressure medium via a control valve. The value which is decisive for pump adjustment or pump traverse, the eccentricity of the lifting ring in connection with radial piston pumps and vane cell pumps or, in connection with axial piston pumps, the pivot angle of the swash plate, is picked up by means of a displacement transducer. This actual value signal from the displacement transducer, which is proportional to the amount conveyed by the pump, is supplied to an electronic servo amplifier and is compared there with the set value provided there. At the same time the actual value of the valve adjustment is provided via a displacement transducer to this servo amplifier, which triggers the control valve. Control of the control valve or of the pump can be provided here via an interior pressure or an exterior pressure supply.

With electrohydraulically adjustable pumps of this type the adjustment member (for example the lifting ring or the swash plate) becomes dependent on the hydraulic clamping of the adjustment manner. Noise generation increases with a falling rigidity of the hydraulic clamping and is caused by the portions of the drive gear forces acting in the direction of the adjustment. Depending on the rigidity of the clamping, this results in a more or less strong excursion of the entire drive gear in accordance with the rhythm of the pistons or chambers entering and exiting the pressure chamber of the pump.

SUMMARY OF THE INVENTION

In contrast to this, the electrohydraulically adjustable pump in accordance with the invention has the advantage that the noise generation of the pump is considerably reduced by reducing the effect of the portion of the drive gear forces acting on the hydraulic clamping of the adjustment member by counter-acting them in accordance with the applicant's invention, the control valve is controlled via the servo amplifier by an additional pulse-shaped adjustment signal which has a function of the angle of rotation of the pump. By means of the control in accordance with the invention of the control valve through an additional pulse-like adjustment signal, which is a function of the angle of rotation of the pump, the oscillations resulting from the drive gear force and thus the operating noise are favorably affected. This action or reduction goes far beyond an effect which would be possible by means of the structural design of the adjustment member or the adjustment pistons and of the layout in accordance with control technology of the position control circuit.

The additional pulse-shaped adjustment signal is formed in an advantageous manner via an rpm signal which is obtained by a conventional rpm sensor at the pump. This rpm sensor detects the passage of the pump pistons or vanes and generates an appropriate signal. This signal is supplied to a signal converter in the form of a trigger signal, which converts the trigger signal into an additional signal by means of a stored characteristic curve or a stored family of characteristic curves and provides it to the servo amplifier to form the additional adjustment signal. By means of this it is possible in an advantageous manner to generate an adjustment signal which is adapted to a defined operational behavior of the pump. It is possible to optimize an adaptation, for example to the nominal operation or to a desired operational behavior, by an appropriate selection of the characteristic curve or the family of characteristic curves.

It is particularly advantageous if the signal converter is additionally supplied with the actual value of the pump adjustment, since by means of this the effect of the pump adjustment on the operating noise is reduced. Since the course of the adjustment force of the adjustment pistons is greatly dependent on operating conditions, such as eccentricity and pump pressure, it is advantageous if, besides the actual value of the piston adjustment, the signal converter is also supplied with the generated pump pressure as an input signal. By an appropriate inclusion of the interference values acting on the hydraulic clamping of the adjustment member and integrating them in a characteristic diagram, it is possible to optimize the additional adjustment signal.

If, in addition to the above mentioned effective values on the hydraulic clamping of the adjustment member, a measured signal depending on the structure-borne noise of the pump is made available, a further improved optimization or adaptation behavior is made possible by means of an appropriate integration at the signal converter.

BRIEF DESCRIPTION OF THE DRAWINGS

The invention will be explained in more detail by means of the description and the following drawings. The latter represent in FIG. 1 the basic circuit diagram, known per se, of an electrohydraulically adjustable control pump in an open circuit with control of the pump or the control valve by means of an interior pressure supply.

DESCRIPTION OF THE PREFERRED EMBODIMENT

Figure 1:
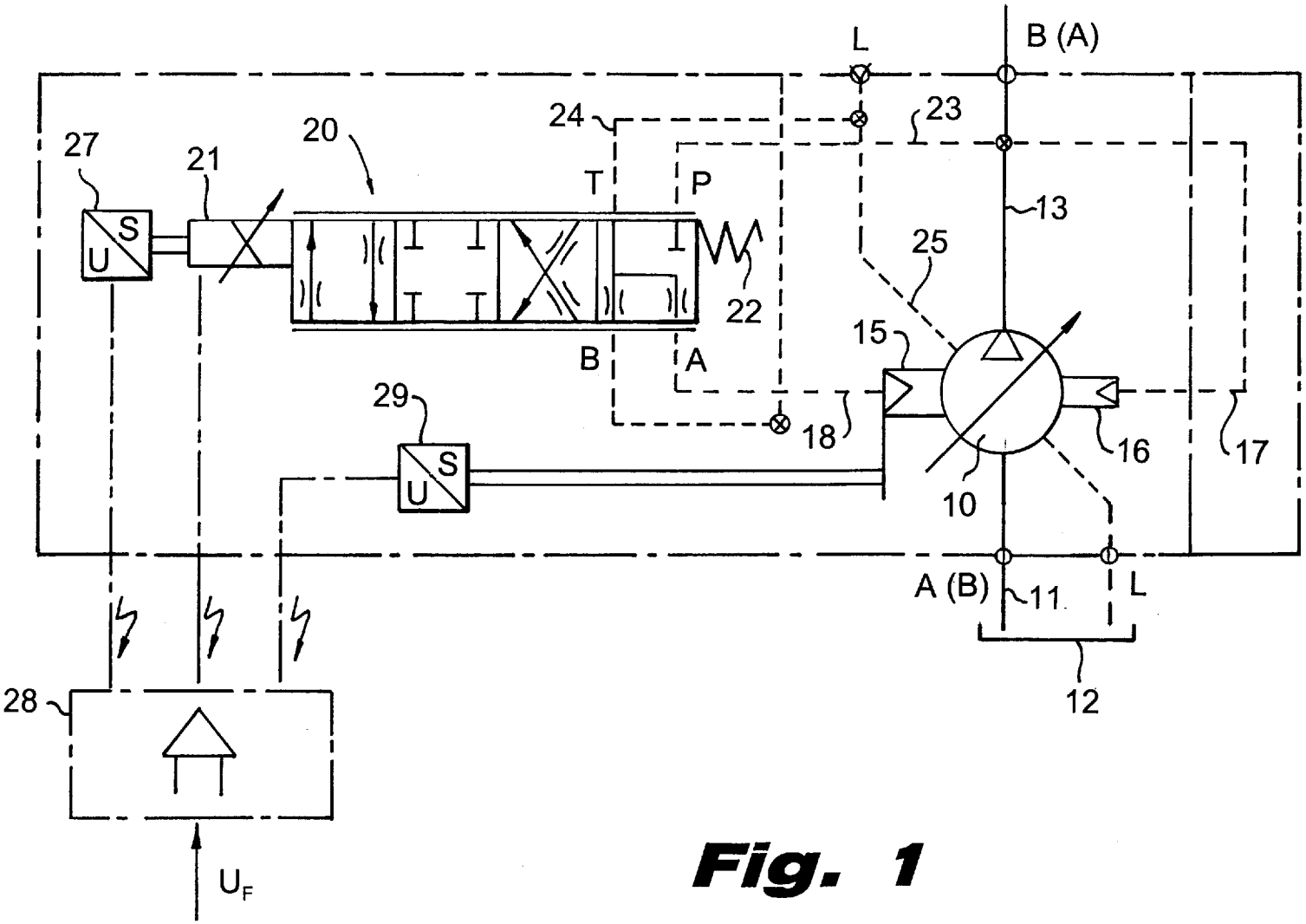

The adjustable pump 10 is connected with a pressure medium reservoir 12 via a suction line 11 and conveys this pressure medium via a pressure line 13 to a consumer, not shown. The adjusting member of the pump, for example the lifting ring 14 (see FIG. 2) is acted upon or fixed in place by two adjustment pistons 15 and 16. The adjustment piston 16 with a smaller piston diameter is connected with the pressure line 13 via a control line 17, so that the smaller adjustment piston 16 is continuously charged with the conveying pressure. The adjustment piston 15 with the larger effective piston diameter is connected with the control valve 20 via a second control line 18. This is embodied, for example, as a 4/4 proportional valve and is moved into its respective position by an adjustment magnet 21 against the force of a spring 22. The control valve 20 is furthermore connected via a line 23 with the pressure line 13 and via a line 24 with a return line 25 or the pressure medium container 12. No further reference will be made here to the further structure and the mode of operation of the proportional or control valve 20, since this is known and not important for the invention.

The operating position of the control valve 20 is picked up by means of a displacement transducer 27 and is supplied as the actual value signal 36 to a servo amplifier 28. Further than that, by means of a displacement transducer 29 disposed at the piston pump 10, the servo amplifier 28 is provided with the operating position of the adjustment member 14 as a further actual value 34. The control valve 20 is controlled by means of this servo amplifier 28 by integrating the respective output signals.

Figure 2:
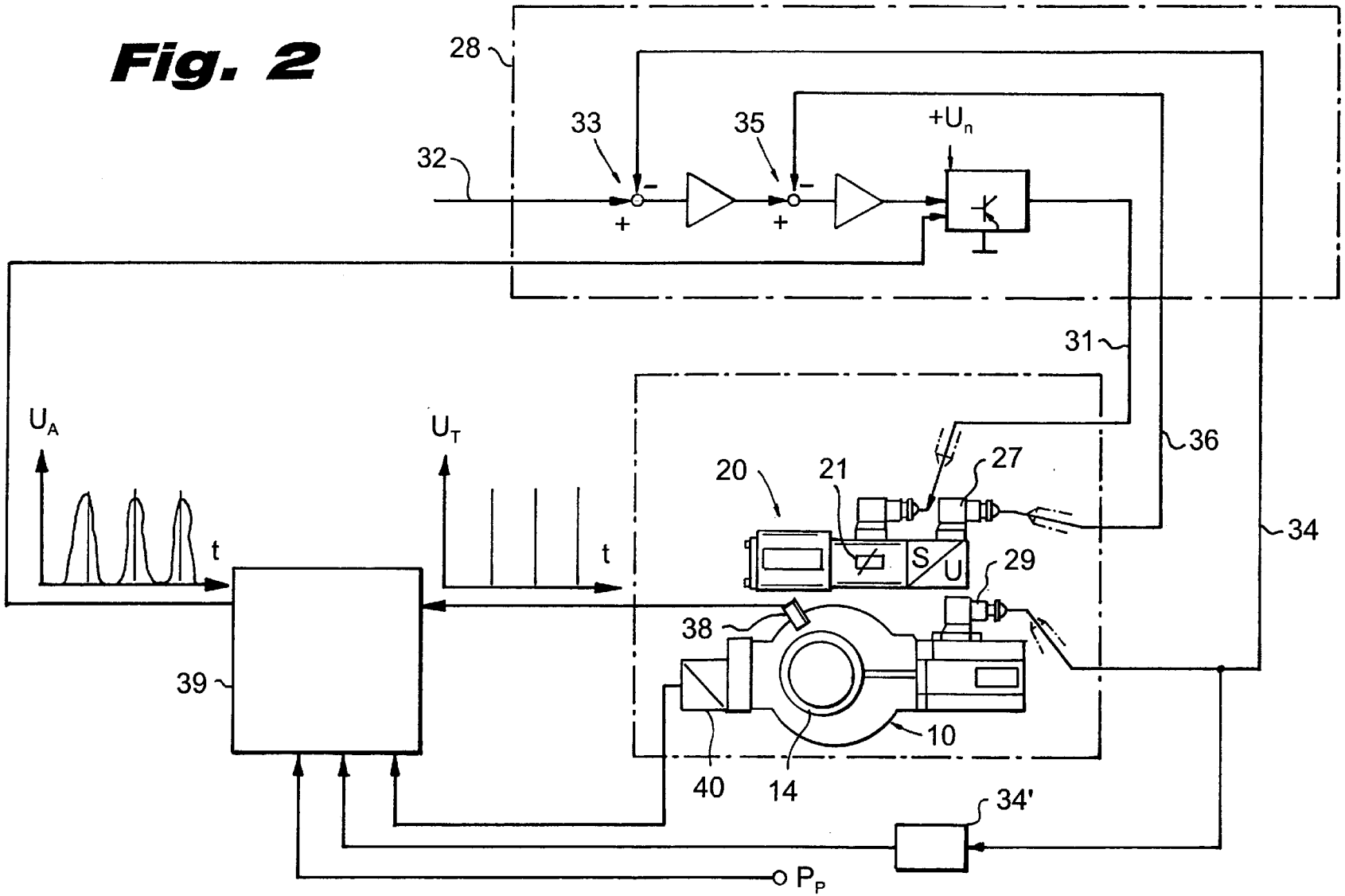
FIG. 2 shows a simplified block circuit diagram of the control device.

The pump 10 and the control valve 20 are schematically represented in the block circuit diagram shown in FIG. 2. The adjustment magnet 21 of the control valve 20 is controlled by the servo amplifier 28 via a control line 31. An operational set value is preset in the servo amplifier by means of an operational set value input 32. At a first adding point 33, the set value preset device is supplied with the actual value signal 34 of the displacement transducer 29 disposed on the adjustment member. The actual value signal 36 of the pre-control valve at the displacement transducer 27 is supplied to the respective input signal of the servo amplifier 28 at a second downstream disposed adding point 35.

In addition to the signal reception described so far, an rpm sensor 38 is disposed on the pump which generates a signal at the passage of a pump piston or pump vane. By means of this, a trigger signal $U_T$, which is supplied to a signal converter 39, is generated by the rpm sensor during the operation of the piston pump. By means of a family of characteristic curves or a characteristic curve stored in the signal converter 39, this trigger signal $U_T$ is converted into an additional signal $U_A$, which is supplied as a further input signal to the end stage of the servo amplifier 28. From the trigger signal $U_T$ the additional signal $U_A$ is transformed by means of the characteristic curve or the family of characteristic curves stored in the signal converter in such a way that a superimposed adjustment signal is triggered in the servo amplifier 28. By means of this the power fluctuations, which act on the adjustment piston because of the effect of the drive gear forces, are compensated. For this, the path and the phase position of the additional signal $U_A$ are generated in such a way that a simultaneous meeting of the power fluctuation from the drive gear and counter-actions at the adjustment pistons is assured, in spite of the delays occurring in the control valve 20. For example, the characteristic curve or the family of characteristic curves stored in the signal converter 39 are tailored to the nominal operation of the pump, i.e. by means of the stored characteristic curve of the normal operating behavior, the trigger signal $U_T$ is adjusted in the signal converter 39 to oscillations occurring in this case based on the force of the drive gear.

These oscillations occurring because of the force of the drive gear or the effect of the drive gear forces on the adjustment pistons or the hydraulic clamping strongly depend on operational conditions, such as the eccentricity of adjustment of the adjustment member or the generated pump pressure. For this reason it is possible to supply the signal converter 39 with the actual value signal 34' of the displacement transducer 29 at the adjustment member in addition to the trigger signal $U_T$ of the rpm sensor 38. It is possible to supply the signal converter 39, either individually or in combination with others, with the actual value of the pump pressure $P_p$ and/or with a signal detected by a measuring sensor 40 at the pump 10 as a function of the structure-borne noise of the pump, as further input signals.

Changes of the embodiment shown are of course possible without deviating from the concept of the invention. Thus it is possible to use a servo valve as the control valve controlling the adjustment piston.

We claim:

1. An electro hydraulically adjustable pump, comprising an adjustment member which is adjustable by at least one adjustment piston; a control valve which acts upon said at least one adjusting piston; a servo amplifier which triggers said control valve and which is supplied with an actual value of a pump adjustment and an actual value of a control valve adjustment; and an element which produces an additional pulse-shape adjusting signal as a function of an angle of rotation of the pump so as to control said control valve through said servo amplifier by said additional pulse-shaped adjustment signal.

2. An electro hydraulically adjustable pump as defined in claim 1, wherein said element is at least rpm sensor generating said additional pulse-shaped adjustment signal.

3. An electro hydraulically adjustable pump as defined in claim 2, wherein said rpm sensor generates said at least one trigger system which is supplied through a signal convertor for transforming said at least one trigger signal into a modified additional signal by a stored characteristic curve or a characteristic family of characteristic curves, and supplies the modified additional signal at said servo amplifier to form said additional pulse-shaped adjustment signal.

4. An electro hydraulically adjustable pump as defined in claim 3, wherein said signal convertor is additionally supplied with an actual value of the pump adjustment.

5. An electro hydraulically adjustable pump as defined in claim 3, wherein said signal convertor is additionally supplied with an actual value of a generated pump pressure.

6. An electro hydraulically adjustable pump as defined in claim 3, wherein said signal convertor is additionally supplied with a noise signal which is a function of a structure-borne noise generated by the pump.

7. An electro hydraulically adjustable pump as defined in claim 3, wherein said signal convertor supplies the modified additional signal so as to bypass controllers of said servo amplifier directly to an end stage of said servo amplifier.

8. An electro hydraulically adjustable pump as defined in claim 1, wherein the electro hydraulically adjustable pump is formed as an axially operating piston pump.

9. An electro hydraulically adjustable pump as defined in claim 1, wherein the electro hydraulically adjustable pump is formed as an radially operating piston pump.

10. An electro hydraulically adjustable pump as defined in claim 1, wherein the electro hydraulically adjustable pump is formed as a vane cell pump.

* * * * *